US006253577B1

(12) United States Patent
Arman et al.

(10) Patent No.: US 6,253,577 B1
(45) **Date of Patent: *Jul. 3, 2001**

(54) CRYOGENIC AIR SEPARATION PROCESS FOR PRODUCING ELEVATED PRESSURE GASEOUS OXYGEN

(75) Inventors: Bayram Arman; Dante Patrick Bonaquist, both of Grand Island; Joseph Alfred Weber, Cheektowaga; Mark Edward Vincett, Lancaster, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/533,252

(22) Filed: Mar. 23, 2000

(51) Int. Cl.[7] ..... F25J 3/00
(52) U.S. Cl. ..... 62/646; 62/940; 62/912
(58) Field of Search ..... 62/643, 646, 912, 62/940, 621

(56) References Cited

U.S. PATENT DOCUMENTS

| | | | | |
|---|---|---|---|---|
| 3,564,571 | * | 2/1971 | Yearout | 62/912 |
| 3,733,845 | | 5/1973 | Lieberman | 62/335 |
| 3,747,359 | * | 7/1973 | Streich | 62/912 |
| 4,192,662 | * | 3/1980 | Ogata et al. | 62/643 |
| 4,345,925 | | 8/1982 | Cheung | 62/13 |
| 5,157,925 | | 10/1992 | Denton et al. | 62/11 |
| 5,287,704 | | 2/1994 | Rathbone | 62/25 |
| 5,379,599 | | 1/1995 | Mostello | 62/25 |
| 5,386,692 | | 2/1995 | Laforce | 62/25 |
| 5,441,658 | | 8/1995 | Boyarsky et al. | 252/67 |
| 5,511,381 | | 4/1996 | Higginbotham | 62/646 |
| 5,579,654 | | 12/1996 | Longsworth et al. | 62/511 |
| 5,622,644 | | 4/1997 | Stevenson et al. | 252/67 |
| 5,650,089 | | 7/1997 | Gage et al. | 252/67 |
| 5,701,761 | * | 12/1997 | Prevost et al. | 62/613 |
| 5,729,993 | | 3/1998 | Boiarski et al. | 62/175 |
| 5,735,142 | | 4/1998 | Grenier | 62/646 |
| 5,765,396 | | 6/1998 | Bonaquist | 62/646 |
| 5,829,271 | | 11/1998 | Lynch et al. | 62/646 |
| 6,053,008 | * | 4/2000 | Arman et al. | 62/646 |

* cited by examiner

*Primary Examiner*—William Doerrler
(74) *Attorney, Agent, or Firm*—Stanley Ktorides

(57) ABSTRACT

A cryogenic air separation process having improved flexibility and operating efficiency for producing elevated pressure gaseous oxygen by vaporizing pressurized liquid oxygen wherein refrigeration generation for the process is decoupled from the flow of process streams and is produced by one or more multicomponent refrigerant fluid circuits.

10 Claims, 2 Drawing Sheets

CRYOGENIC AIR SEPARATION PROCESS FOR PRODUCING ELEVATED PRESSURE GASEOUS OXYGEN

TECHNICAL FIELD

This invention relates generally to the separation of feed air by cryogenic rectification and, more particularly, to the production of elevated pressure gaseous oxygen.

BACKGROUND ART

The production of gaseous oxygen by the cryogenic rectification of feed air requires the provision of a significant amount of refrigeration to drive the separation. Generally such refrigeration is provided by the turboexpansion of a process stream, such as a portion of the feed air. While this conventional practice is effective, it is limiting because an increase in the amount of refrigeration inherently affects the operation of the overall process. It is therefore desirable to have a cryogenic air separation process wherein the provision of the requisite refrigeration is independent of the flow of process streams for the system.

The refrigeration problem is more acute when the product gaseous oxygen is desired at an elevated pressure because generally in such a situation the oxygen is taken from the column system as liquid, pumped to a higher pressure, and then vaporized to produce the elevated pressure product. The removal of liquid oxygen from the column system increases the amount of refrigeration which must be delivered to the column system to drive the separation.

One method for providing refrigeration for a cryogenic air separation system which is independent of the flow of internal system process streams is to provide the requisite refrigeration in the form of exogenous cryogenic liquid brought into the system. Unfortunately such a procedure is very costly.

Accordingly it is an object of this invention to provide an improved cryogenic air separation process for the production of elevated pressure gaseous oxygen wherein the provision of the requisite refrigeration for the separation is independent of the flow of process streams.

It is another object of this invention to provide a cryogenic air separation process for the production of elevated pressure gaseous oxygen wherein the provision of the requisite refrigeration for the separation is independently and efficiently provided to the system.

SUMMARY OF THE INVENTION

The above and other objects which will become apparent to those skilled in the art upon a reading of this disclosure, are attained by the present invention, one aspect of which is:

A process for the production of elevated pressure gaseous oxygen comprising:

(A) compressing a multicomponent refrigerant fluid, cooling the compressed multicomponent refrigerant fluid, expanding the cooled, compressed multicomponent refrigerant fluid, and warming the expanded multicomponent refrigerant fluid by indirect heat exchange with said cooling compressed multicomponent refrigerant fluid and also with feed air to produce cooled feed air;

(B) passing the cooled feed air into a higher pressure cryogenic rectification column and separating the feed air by cryogenic rectification within the higher pressure cryogenic rectification column to produce oxygen-enriched fluid;

(C) passing the oxygen-enriched fluid into a lower pressure cryogenic rectification column, and producing oxygen-rich liquid by cryogenic rectification within the lower pressure column;

(D) withdrawing oxygen-rich liquid from the lower pressure column, elevating the pressure of the oxygen-rich liquid to produce elevated pressure oxygen-rich liquid, and vaporizing the elevated pressure oxygen-rich liquid by indirect heat exchange with the multicomponent refrigerant fluid to produce oxygen rich gas; and (E) recovering the oxygen-rich gas as product elevated pressure gaseous oxygen.

Another aspect of the invention is:

A process for the production of elevated pressure gaseous oxygen comprising:

(A) compressing a high temperature multicomponent refrigerant fluid, cooling the compressed high temperature multicomponent refrigerant fluid, expanding the cooled, compressed high temperature multicomponent refrigerant fluid, and warming the expanded high temperature multicomponent refrigerant fluid by indirect heat exchange with said cooling compressed high temperature multicomponent refrigerant fluid and with low temperature multicomponent refrigerant fluid and also with feed air;

(B) compressing low temperature multicomponent refrigerant fluid, cooling the compressed low temperature multicomponent refrigerant fluid, expanding the cooled, compressed low temperature multicomponent refrigerant fluid, and warming the expanded low temperature multicomponent refrigerant fluid by indirect heat exchange with said cooling compressed low temperature multicomponent refrigerant fluid and also with feed air to produce cooled feed air;

(C) passing the cooled feed air into a higher pressure cryogenic rectification column and separating the feed air by cryogenic rectification within the higher pressure cryogenic rectification column to produce oxygen-enriched fluid;

(D) passing the oxygen-enriched fluid into a lower pressure cryogenic rectification column, and producing oxygen-rich liquid by cryogenic rectification within the lower pressure column;

(E) withdrawing oxygen-rich liquid from the lower pressure column, elevating the pressure of the oxygen-rich liquid, and vaporizing the elevated pressure oxygen-rich liquid by indirect heat exchange with the low temperature multicomponent refrigerant fluid to produce oxygen-rich gas; and (F) recovering the oxygen-rich gas as product elevated pressure gaseous oxygen.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the more volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluid streams into heat exchange relation without any physical contact or intermixing of the fluids with each other.

As used herein the term "expansion" means to effect a reduction in pressure.

As used herein the term "product gaseous oxygen" means a gas having an oxygen concentration of at least 90 mole percent.

As used herein the term "feed air" means a mixture comprising primarily oxygen, nitrogen and argon, such as ambient air.

As used herein the terms "upper portion" and "lower portion" mean those sections of a column respectively above and below the mid point of the column.

As used herein the term "variable load refrigerant" means a multicomponent fluid, i.e. a mixture of two or more components, in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the multicomponent refrigerant fluid is at least 10° K., preferably at least 20° K. and most preferably at least 50° K.

As used herein the term "fluorocarbon" means one of the following: tetrafluoromethane ($CF_4$), perfluoroethane ($C_2F_6$), perfluoropropane ($C_3F_8$), perfluorobutane ($C_4F_{10}$), perfluoropentane ($C_5F_{12}$), perfluoroethene ($C_2F_4$), perfluoropropene ($C_3F_6$), perfluorobutene ($C_4F_8$), perfluoropentene ($C_5F_{10}$), perfluorohexane ($C_6F_{12}$), hexafluorocyclopropane (cyclo-$C_3F_6$) and octafluorocyclobutane (cyclo-$C_4F_8$).

As used herein the term "hydrofluorocarbon" means one of the following: fluoroform ($CHF_3$), pentafluoroethane ($C_2HF_5$), tetrafluoroethane ($C_2H_2F_4$), heptafluoropropane ($C_3HF_7$), hexafluoropropane ($C_3H_2F_6$), pentafluoropropane ($C_3H_3F_5$), tetrafluoropropane ($C_3H_4F_4$), nonafluorobutane ($C_4HF_9$), octafluorobutane ($C_4H_2F_8$), undecafluoropentane ($C_5HF_{11}$), methyl fluoride ($CH_3F$), difluoromethane ($CH_2F_2$), ethyl fluoride ($C_2H_5F$), difluoroethane ($C_2H_4F_2$) trifluoroethane ($C_2H_3F_3$), difluoroethene ($C_2H_2F_2$), trifluoroethene ($C_2HF_3$), fluoroethene ($C_2H_3F$), pentafluoropropene ($C_3HF_5$), tetrafluoropropene ($C_3H_2F_4$), trifluoropropene ($C_3H_3F_3$), difluoropropene ($C_3H_4F_2$), heptafluorobutene ($C_4HF_7$), hexafluorobutene ($C_4H_2F_6$), hexafluorobutane ($C_4H_4F_6$), decafluoropentane ($C_5H_2F_{10}$), undecafluoropentane ($C_5HF_{11}$) and nonafluoropentene ($C_5HF_9$).

As used herein the term "fluoroether" means one of the following: trifluoromethyoxy-perfluoromethane ($CF_3$—O—$CF_3$), difluoromethoxy-perfluoromethane ($CHF_2$—O—$CF_3$), fluoromethoxy-perfluoromethane ($CH_2F$—O—$CF_3$), difluoromethoxy-difluoromethane ($CHF_2$—O—$CHF_2$), difluoromethoxy-perfluoroethane ($CHF_2$—O—$C_2F_5$), difluoromethoxy-1,2,2,2-tetrafluoroethane ($CHF_2$—O—$C_2HF_4$), difluoromethoxy-1,1,2,2-tetrafluoroethane ($CHF_2$—O—$C_2HF_4$), perfluoroethoxy-fluoromethane ($C_2F_5$—O—$CH_2F$), perfluoromethoxy-1,1,2-trifluoroethane ($CF_3$—O—$C_2H_2F_3$), perfluoromethoxy-1,2,2-trifluoroethane ($CF_3O$—$C_2H_2F_3$), cyclo-1,1,2,2-tetrafluoropropylether (Cyclo-$C_3H_2F_4$—O—), cyclo-1,1,3,3-tetrafluoropropylether (cyclo-$C_3H_2F_4$—O—), perfluoromethoxy-1,1,2,2-tetrafluoroethane ($CF_3$—O—$C_2HF_4$), cyclo-1,1,2,3,3-pentafluoropropylether (cyclo-$C_3H_5$—O—), perfluoromethoxy-perfluoroacetone ($CF_3$—O—$CF_2$—O—$CF_3$), perfluoromethoxy-perfluoroethane ($CF_3$—O—$C_2F_5$), perfluoromethoxy-1,2,2,2-tetrafluoroethane ($CF_3$—O—$C_2HF_4$), perfluoromethoxy-2,2,2-trifluoroethane ($CF_3$—O—$C_2H_2F_3$), cyclo-perfluoromethoxy-perfluoroacetone (cyclo-$CF_2$—O—$CF_2$—O—$CF_2$—), perfluorobutoxy-methane ($C_4F_9$—O—$CH_3$), perfluoropropoxy-methane ($C_3F_7$—O—$CH_3$), perfluoroethoxy-methane ($C_2F_5$—O—$CH_3$) and cyclo-perfluoropropylether (cyclo-$C_3F_6$—O).

As used herein the term "atmospheric gas" means one of the following: nitrogen ($N_2$), argon (Ar), krypton (Kr), xenon (Xe), neon (Ne), carbon dioxide ($CO_2$), oxygen ($O_2$) and helium (He).

As used herein the term "non-toxic" means not posing an acute or chronic hazard when handled in accordance with acceptable exposure limits.

As used herein the term "non-flammable" means either having no flash point or a very high flash point of at least 600° K.

As used herein the term "low-ozone-depleting" means having an ozone depleting potential less than 0.15 as defined by the Montreal Protocol convention wherein dichlorofluoromethane ($CCl_2F_2$) has an ozone depleting potential of 1.0.

As used herein the term "non-ozone-depleting" means having no component which contains a chlorine, bromine or iodine atom.

As used herein the term "normal boiling point" means the boiling temperature at 1 standard atmosphere pressure, i.e. 14.696 pounds per square inch absolute.

DETAILED DESCRIPTION

The invention comprises the decoupling of the refrigeration generation for a cryogenic air separation process from the flow of process streams for the process. This enables one to change the amount of refrigeration put into the process without requiring a change in flow of process streams. The capability to provide variable refrigeration supply as a function of temperature level enables proper cooling curve matching leading to lower energy requirements without burdening the system with excessive turboexpansion of process streams to generate the necessary refrigeration, although, if desired, some refrigeration for the process may still be generated by turboexpansion of one or more process streams.

Figure 1:
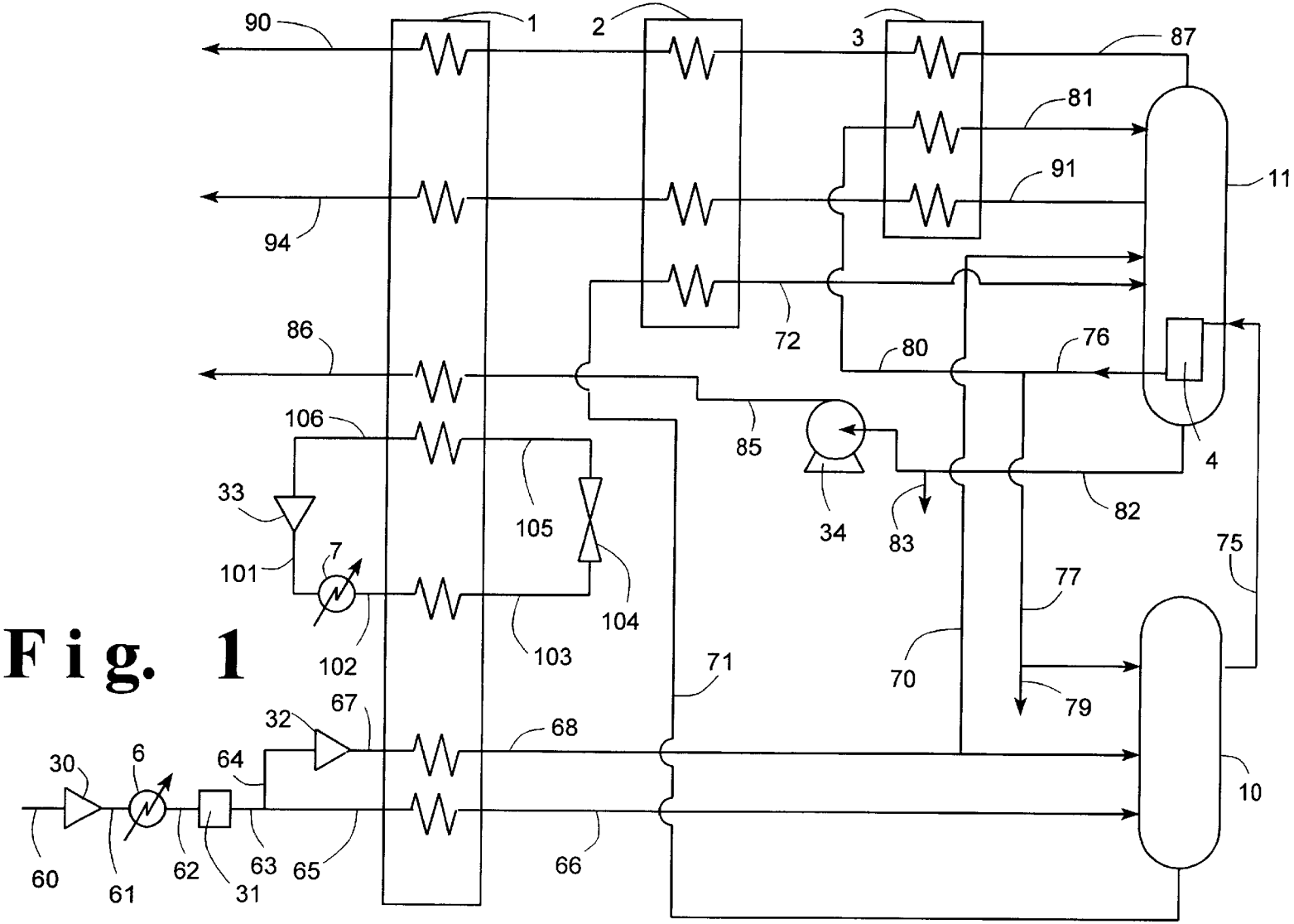
FIG. 1 is a schematic representation of one preferred embodiment of the invention wherein a single multicomponent refrigerant circuit is used to produce the refrigeration for the separation.

The invention will be described in greater detail with reference to the Drawings. Referring now to FIG. 1, feed air 60 is compressed by passage through base load compressor 30 to a pressure generally within the range of from 60 to 200 pounds per square inch absolute (psia). Resulting compressed feed air 61 is cooled of the heat of compression in aftercooler 6 and resulting feed air stream 62 is then cleaned of high boiling impurities such as water vapor, carbon dioxide and hydrocarbons by passage through purifier 31. Purified feed air stream 63 is divided into streams 64 and 65. Stream 64 is increased in pressure by passage through booster compressor 32 to a pressure generally within the range of from 100 to 1000 psia to form booster feed air stream 67. Feed air streams 65 and 67 are cooled by passage through main heat exchanger 1 by indirect heat exchange with return streams and by refrigeration generated by the multicomponent refrigerant fluid circuit as will be more fully described below, and then passed as streams 66 and 68 respectively into higher pressure column 10 which is operating at a pressure generally within the range of from 60 to 200 psia. A portion 70 of stream 68 may also be passed into lower pressure column 11.

Within higher pressure column 10 the feed air is separated by cryogenic rectification into nitrogen-enriched fluid and oxygen-enriched fluid. Nitrogen-enriched fluid is withdrawn as vapor from the upper portion of higher pressure column 10 in stream 75 and condensed in main condenser 4 by indirect heat exchange with boiling lower pressure column bottom liquid. Resulting nitrogen-enriched liquid 76 is returned to column 10 as reflux as shown by stream 77. A portion 80 of the nitrogen-enriched liquid 76 is passed from column 10 to subcooler 3 wherein it is subcooled to form subcooled stream 81 which is passed into the upper portion of column 11 as reflux. If desired, a portion 79 of stream 77 may be recovered as product liquid nitrogen. Also, if desired, a portion (not shown) of nitrogen-enriched vapor stream 75 may be recovered as product high pressure nitrogen gas.

Oxygen-enriched fluid is withdrawn as liquid from the lower portion of higher pressure column 10 in stream 71 and passed to subcooler 2 wherein it is subcooled. Resulting subcooled oxygen-enriched liquid 72 is then passed into lower pressure column 11.

Lower pressure column 11 is operating at a pressure less than that of higher pressure column 10 and generally within the range of from 15 to 150 psia. Within lower pressure column 11 the various feeds into that column are separated by cryogenic rectification into nitrogen-rich vapor and oxygen-rich liquid. Nitrogen-rich vapor is withdrawn from the upper portion of column 11 in stream 87, warmed by passage through heat exchangers 3, 2 and 1, and recovered as product gaseous nitrogen in stream 90 having a nitrogen concentration of at least 99 mole percent, preferably at least 99.9 mole percent, and most preferably at least 99.999 mole percent. For product purity control purposes a waste stream 91 is withdrawn from column 11 from a level below the withdrawal point of stream 87, warmed by passage through heat exchangers 3, 2 and 1, and removed from the system in stream 94.

Oxygen-rich liquid is withdrawn from the lower portion of lower pressure column 11 in stream 82. If desired, a portion 83 of stream 82 may be recovered as a product liquid oxygen having an oxygen concentration generally within the range of from 90 to 99.9 mole percent. Stream 82 is then passed to liquid pump 34 wherein it is pumped to an elevated pressure generally within the range of from 35 to 500 psia. Any other suitable means for elevating the pressure of the oxygen-rich liquid may also be used in the practice of this invention. Resulting elevated pressure oxygen-rich liquid 85 is vaporized by indirect heat exchange with multicomponent refrigerant fluid and then recovered as elevated pressure gaseous oxygen product 86. In the embodiment of the invention illustrated in FIG. 1, the vaporization of the elevated pressure oxygen-rich liquid against the multicomponent refrigerant fluid is shown as occurring within main heat exchanger 1. This vaporization can also occur within a separate heat exchanger such as a standalone product boiler.

There will now be described in greater detail the operation of the multicomponent refrigerant fluid circuit which serves to generate preferably all the refrigeration passed into the cryogenic rectification plant thereby eliminating the need for any turboexpansion of a process stream to produce refrigeration for the separation, thus decoupling the generation of refrigeration for the cryogenic air separation process from the flow of process streams, such as feed air, associated with the cryogenic air separation process.

The following description illustrates the multicomponent refrigerant fluid system for providing refrigeration throughout the primary heat exchanger 1. Multicomponent refrigerant fluid in stream 106 is compressed by passage through recycle compressor 33 to a pressure generally within the range of from 45 to 800 psia to produce compressed refrigerant fluid 101. The compressed refrigerant fluid is cooled of the heat of compression by passage through aftercooler 7 and may be partially condensed. The resulting multicomponent refrigerant fluid in stream 102 is then passed through heat exchanger 1 wherein it is further cooled and generally is at least partially condensed and may be completely condensed. This cooling serves to warm and vaporize the elevated pressure oxygen-rich liquid. The resulting cooled, compressed multicomponent refrigerant fluid 103 is then expanded or throttled through valve 104. The throttling preferably partially vaporizes the multicomponent refrigerant fluid, cooling the fluid and generating refrigeration. For some limited circumstances, dependent on heat exchanger conditions, the compressed fluid 103 may be subcooled liquid prior to expansion and may remain as liquid upon initial expansion. Subsequently, upon warming in the heat exchanger, the fluid will have two phases. The pressure expansion of the fluid through a valve would provide refrigeration by the Joule-Thomson effect, i.e. lowering of the fluid temperature due to pressure expansion at constant enthalpy. However, under some circumstances, the fluid expansion could occur by utilizing a two-phase or liquid expansion turbine, so that the fluid temperature would be lowered due to work expansion.

Refrigeration bearing multicomponent two phase refrigerant fluid stream 105 is then passed through heat exchanger 1 wherein it is warmed and completely vaporized thus serving by indirect heat exchange to cool stream 102 and also to transfer refrigeration into the process streams within the heat exchanger, including feed air streams 65, and 67, thus passing refrigeration generated by the multicomponent refrigerant fluid refrigeration circuit into the cryogenic rectification plant to sustain the cryogenic air separation process. The resulting warmed multicomponent refrigerant fluid in vapor stream 106 is then recycled to compressor 33 and the refrigeration cycle starts anew. In the multicomponent refrigerant fluid refrigeration cycle, while the high pressure mixture is condensing, the low pressure mixture is boiling against it, i.e. the heat of condensation boils the low-pressure liquid. At each temperature level, the net difference between the vaporization and the condensation provides the refrigeration. For a given refrigerant component combination, mixture composition, flowrate and pressure levels determine the available refrigeration at each temperature level.

The multicomponent refrigerant fluid contains two or more components in order to provide the required refrigeration at each temperature. The choice of refrigerant components will depend on the refrigeration load versus temperature for the specific process. Suitable components will be chosen depending upon their normal boiling points, latent heat, and flammability, toxicity, and ozone-depletion potential.

One preferable embodiment of the multicomponent refrigerant fluid useful in the practice of this invention comprises at least two components from the group consisting of fluorocarbons, hydrofluorocarbons and fluoroethers.

Another preferable embodiment of the multicomponent refrigerant fluid useful in the practice of this invention comprises at least one component from the group consisting of fluorocarbons, hydrofluorocarbons and fluoroethers, and at least one atmospheric gas.

Another preferable embodiment of the multicomponent refrigerant fluid useful in the practice of this invention comprises at least two components from the group consisting of fluorocarbons, hydrofluorocarbons and fluoroethers, and at least two atmospheric gases.

Another preferable embodiment of the multicomponent refrigerant fluid useful in the practice of this invention comprises at least one fluoroether and at least one component from the group consisting of fluorocarbons, hydrofluorocarbons, fluoroethers and atmospheric gases.

In one preferred embodiment the multicomponent refrigerant fluid consists solely of fluorocarbons. In another preferred embodiment the multicomponent refrigerant fluid consists solely of fluorocarbons and hydrofluorocarbons. In another preferred embodiment the multicomponent refrigerant fluid consists solely of fluorocarbons and atmospheric gases. In another preferred embodiment the multicomponent refrigerant fluid consists solely of fluorocarbons, hydrofluorocarbons and fluoroethers. In another preferred embodiment the multicomponent refrigerant fluid consists solely of fluorocarbons, fluoroethers and atmospheric gases.

The multicomponent refrigerant fluid useful in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, non-flammable and non-ozone-depleting and most preferably every component of the multicomponent refrigerant fluid is either a fluorocarbon, hydrofluorocarbon, fluoroether or atmospheric gas.

The invention is particularly advantageous for use in efficiently reaching cryogenic temperatures from ambient temperatures. Tables 1–8 list preferred examples of multicomponent refrigerant fluid mixtures useful in the practice of this invention. The concentration ranges given in the Tables are in mole percent.

TABLE 1

| COMPONENT | CONCENTRATION RANGE |
|---|---|
| $C_5F_{12}$ | 5–25 |
| $C_4F_{10}$ | 0–15 |
| $C_3F_8$ | 10–40 |
| $C_2F_6$ | 0–30 |
| $CF_4$ | 10–50 |
| Ar | 0–40 |
| $N_2$ | 10–80 |

TABLE 2

| COMPONENT | CONCENTRATION RANGE |
|---|---|
| $C_3H_3F_5$ | 5–25 |
| $C_4F_{10}$ | 0–15 |
| $C_3F_8$ | 10–40 |
| $CHF_3$ | 0–30 |
| $CF_4$ | 10–50 |
| Ar | 0–40 |
| $N_2$ | 10–80 |

TABLE 3

| COMPONENT | CONCENTRATION RANGE |
|---|---|
| $C_4H_4F_6$ | 5–25 |
| $C_3H_2F_6$ | 0–15 |
| $C_2H_2F_4$ | 0–20 |
| $C_2HF_5$ | 5–20 |
| $C_2F_6$ | 0–30 |
| $CF_4$ | 10–50 |
| Ar | 0–40 |
| $N_2$ | 10–80 |

TABLE 4

| COMPONENT | CONCENTRATION RANGE |
|---|---|
| $C_3F_7$—O—$CH_3$ | 5–25 |
| $C_4H_{10}$ | 0–15 |
| $CF_3$—O—$C_2F_3$ | 10–40 |
| $C_2F_6$ | 0–30 |
| $CF_4$ | 10–50 |
| Ar | 0–40 |
| $N_2$ | 10–80 |

TABLE 5

| COMPONENT | CONCENTRATION RANGE |
|---|---|
| $C_3H_3F_5$ | 5–25 |
| $C_3H_2F_6$ | 0–15 |
| $CF_3—O—C_2F_3$ | 10–40 |
| $CHF_3$ | 0–30 |
| $CF_4$ | 0–25 |
| Ar | 0–40 |
| $N_2$ | 10–80 |

TABLE 6

| COMPONENT | CONCENTRATION RANGE |
|---|---|
| $C_3HCl_2F_5$ | 5–25 |
| $C_2HClF_4$ | 0–15 |
| $C_3F_8$ | 10–40 |
| $CHF_3$ | 0–30 |
| $CF_4$ | 0–25 |
| Ar | 0–40 |
| $N_2$ | 10–80 |

TABLE 7

| COMPONENT | CONCENTRATION RANGE |
|---|---|
| $C_2HCl_2F_3$ | 5–25 |
| $C_2HClF_4$ | 0–15 |
| $CF_3—O—C_2F_3$ | 10–40 |
| $CHF_3$ | 0–30 |
| $CF_4$ | 0–25 |
| Ar | 0–40 |
| $N_2$ | 10–80 |

TABLE 8

| COMPONENT | CONCENTRATION RANGE |
|---|---|
| $C_2HCl_2F_3$ | 5–25 |
| $C_2HClF_4$ | 0–15 |
| $C_2H_2F_4$ | 0–15 |
| $C_2HF_5$ | 10–40 |
| $CHF_3$ | 0–30 |
| $CF_4$ | 0–25 |
| Ar | 0–40 |
| $N_2$ | 10–80 |

In a preferred embodiment of the invention each of the two or more components of the refrigerant mixture has a normal boiling point which differs by at least 5 degrees Kelvin, more preferably by at least 10 degrees Kelvin, and most preferably by at least 20 degrees Kelvin, from the normal boiling point of every other component in the refrigerant mixture. This enhances the effectiveness of providing refrigeration over a wide temperature range which encompasses cryogenic temperatures. In a particularly preferred embodiment of the invention, the normal boiling point of the highest boiling component of the multicomponent refrigerant fluid is at least 50° K., preferably at least 100° K., most preferably at least 200° K., greater than the normal boiling point of the lowest boiling component of the multicomponent refrigerant fluid.

Figure 2:
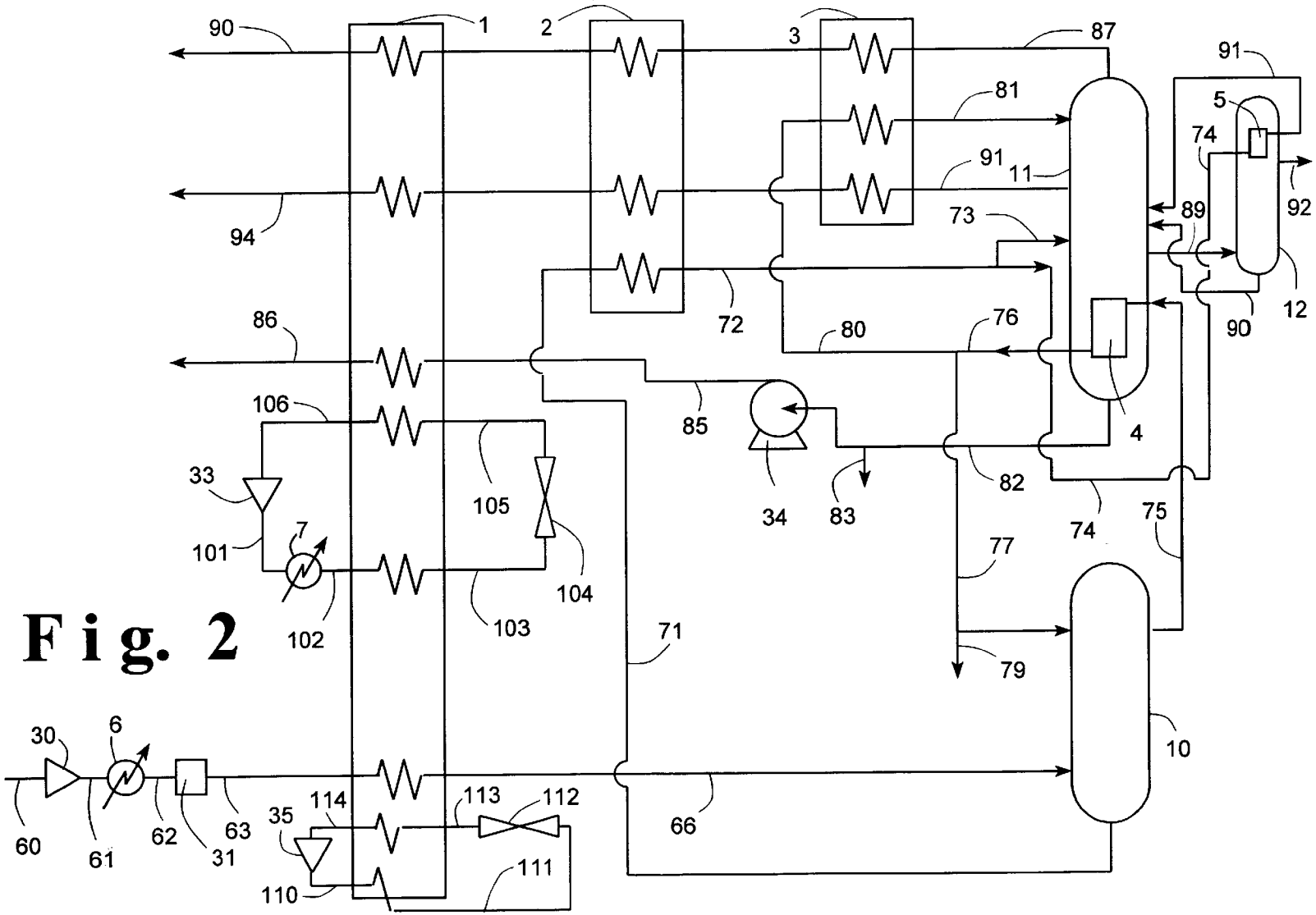
FIG. 2 is a schematic representation of another preferred embodiment of the invention wherein two multicomponent refrigerant circuits, a high temperature circuit and a low temperature circuit, are used to produce the refrigeration for the system.

FIG. 2 illustrates another preferred embodiment of the invention wherein more than one multicomponent refrigerant fluid circuit is employed and an argon sidearm column is used in addition to the double column of columns 10 and 11. In the specific embodiment illustrated in FIG. 2 there are two multicomponent refrigerant fluid circuits employed, a high temperature circuit and a low temperature circuit. The multicomponent refrigerant fluid in the high temperature circuit will contain primarily higher boiling components and the multicomponent refrigerant fluid in the low temperature circuit will contain primarily lower boiling components. By the use of multiple multicomponent refrigerant fluid circuits such as the arrangement illustrated in FIG. 2, one can more effectively avoid any problems associated with the freezing of any component, thus improving the efficiency of the systems. The numerals of FIG. 2 are the same as those of FIG. 1 for the common elements and these common elements will not be described again in detail.

In the embodiment illustrated in FIG. 2, feed air stream 63 is not divided but rather is passed directly through heat exchanger 1 and as stream 66 into higher pressure column 10. Subcooled oxygen-enriched liquid 72 is divided into portion 73 and portion 74. Portion 73 is passed into lower pressure column 11 and portion 74 is passed into argon column condenser 5 wherein it is at least partially vaporized. The resulting vapor is withdrawn from condenser 5 in stream 91 and passed into lower pressure column 11. Any remaining oxygen-enriched liquid is withdrawn from condenser 5 and then passed into lower pressure column 11.

Fluid comprising oxygen and argon is passed in stream 89 from lower pressure column 11 into argon column 12 wherein it is separated by cryogenic rectification into argon-richer fluid and oxygen-richer fluid. oxygen-richer fluid is passed from the lower portion of column 12 in stream 90 into lower pressure column 11. Argon-richer fluid is passed from the upper portion of column 12 as vapor into argon column condenser 5 wherein it is condensed by indirect heat exchange with the aforesaid subcooled oxygen-enriched liquid. Resulting argon-richer liquid is withdrawn from condenser 5. A portion of the argon-richer liquid is passed into argon column 12 as reflux and another portion is recovered as product argon having an argon concentration generally within the range of from 95 to 99.9 mole percent as shown by stream 92.

High temperature multicomponent refrigerant fluid in stream 114 is compressed by passage through recycle compressor 35 to a pressure generally within the range of from 45 to 300 psia to produce compressed high temperature refrigerant fluid 110. The compressed refrigerant fluid is then passed partially through heat exchanger 1 wherein it is cooled and preferably is at least partially condensed and may be completely condensed. The cooled, compressed high temperature multicomponent refrigerant fluid 111 is then expanded or throttled through valve 112. The throttling preferably partially vaporizes the high temperature multicomponent refrigerant fluid, cooling the fluid and generating refrigeration. Resulting high temperature multicomponent refrigerant fluid in stream 113 has a temperature generally within the range of from 120 to 270K, preferably from 120 to 250K. Stream 113 is then passed through heat exchanger 1 wherein it is warmed by indirect heat exchange with the cooling high temperature multicomponent refrigerant fluid in stream 110, with feed air in stream 63, and also with the multicomponent refrigerant fluid circulating in the other multicomponent refrigerant fluid circuit, termed the low temperature multicomponent refrigerant circuit, which is operating in a manner similar to that described in conjunction with the embodiment illustrated in FIG. 1. In the multiple circuit embodiment illustrated in FIG. 2, the low temperature multicomponent refrigerant fluid in stream 105 has a temperature generally within the range of from 80 to 200K, preferably from 80 to 150K.

Table 9 presents illustrative examples of high temperature (column A) and low temperature (column B) multicomponent refrigerant fluids which may be used in the practice of the invention in accordance with the embodiment illustrated in FIG. 2. The compositions are in mole percent.

TABLE 9

| COMPONENT | COMPOSITION (A) | COMPOSITION (B) |
|---|---|---|
| $C_2HCl_2F_3$ | 5–30 | 0–25 |
| $C_2HClF_4$ | 0–30 | 0–15 |
| $C_2H_2F_4$ | 0–30 | 0–15 |
| $C_2HF_5$ | 10–40 | 0–40 |
| $CHF_3$ | 0–30 | 0–30 |
| $CF_4$ | 5–30 | 10–50 |
| Ar | 0–15 | 0–40 |
| $N_2$ | 0–15 | 10–80 |

The components and their concentrations which make up the multicomponent refrigerant fluids useful in the practice of this invention preferably are such as to form a variable load multicomponent refrigerant fluid and preferably maintain such a variable load characteristic throughout the whole temperature range of the method of the invention. This markedly enhances the efficiency with which the refrigeration can be generated and utilized over such a wide temperature range. The defined preferred group of components has an added benefit in that they can be used to form fluid mixtures which are non-toxic, non-flammable and low or non-ozone-depleting. This provides additional advantages over conventional refrigerants which typically are toxic, flammable and/or ozone-depleting.

One preferred variable load multicomponent refrigerant fluid useful in the practice of this invention which is non-toxic, non-flammable and non-ozone-depleting comprises two or more components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$, $CF_3$—O—$CF_3$, $C_2F_6$, $CHF_3$, $CF_4$, $C_4F_9$—O—$CH_3$, $C_6F_{14}$, $C_5HF_{11}$, $C_5H_2F_{10}$, $C_3F_7$—O—$CH_3$, $C_4H_4F_6$, $C_2F_5$—O—$CH_3$, $CO_2$, $O_2$, Ar, $N_2$, Ne and He.

Although the invention has been described in detail with reference to certain preferred embodiments, those skilled in the art will recognize that there are other embodiments of the invention within the spirit and the scope of the claims. For example the multicomponent refrigerant fluid refrigeration circuit in the practice of this invention may employ internal recycle wherein the compression is followed by at least one step of partial condensation at an intermediate temperature, followed by separation, throttling and recycle of the condensate, with the returning vapor portion, after evaporation to the suction of the compressor. Removal or recycle of the high boiling point component(s) provides higher thermodynamic efficiencies and eliminates the possibility of freeze up at the lower temperatures.

What is claimed is:

1. A process for the production of elevated pressure gaseous oxygen comprising:

(A) compressing a multicomponent refrigerant fluid, cooling the compressed multicomponent refrigerant fluid, expanding the cooled, compressed multicomponent refrigerant fluid, and warming the expanded multicomponent refrigerant fluid by indirect heat exchange with said cooling compressed multicomponent refrigerant fluid and also with feed air to produce cooled feed air;

(B) passing the cooled feed air into a higher pressure cryogenic rectification column and separating the feed air by cryogenic rectification within the higher pressure cryogenic rectification column to produce oxygen-enriched fluid;

(C) passing the oxygen-enriched fluid into a lower pressure cryogenic rectification column, and producing oxygen-rich liquid by cryogenic rectification within the lower pressure column;

(D) withdrawing oxygen-rich liquid from the lower pressure column, elevating the pressure of the oxygen-rich liquid to produce elevated pressure oxygen-rich liquid, and vaporizing the elevated pressure oxygen-rich liquid by indirect heat exchange with the multicomponent refrigerant fluid to produce oxygen rich gas; and (E) recovering the oxygen-rich gas as product elevated pressure gaseous oxygen.

2. The process of claim 1 wherein the expansion of the cooled, compressed multicomponent refrigerant fluid produces a two-phase multicomponent refrigerant fluid.

3. The process of claim 1 wherein the multicomponent refrigerant fluid comprises at least two components from the group consisting of fluorocarbons, hydrofluorocarbons and fluoroethers.

4. The process of claim 1 wherein the multicomponent refrigerant fluid comprises at least one component from the group consisting of fluorocarbons, hydrofluorocarbons and fluoroethers and at least one atmospheric gas.

5. The process of claim 1 wherein the multicomponent refrigerant fluid comprises at least two components from the group consisting of fluorocarbons, hydrofluorocarbons and fluoroethers and at least two atmospheric gases.

6. The process of claim 1 wherein the multicomponent refrigerant fluid comprises at least one fluoroether and at least one component from the group consisting of fluorocarbons, hydrofluorocarbons, fluoroethers and atmospheric gases.

7. The process of claim 1 wherein the multicomponent refrigerant fluid comprises at least one component from the group consisting of fluorocarbons, hydrofluorocarbons, hydrochlorofluorocarbons and fluoroethers, and at least one atmospheric gas.

8. The process of claim 1 wherein the multicomponent refrigerant fluid comprises at least two components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$, $CF_3$—O—$CF_3$, $C_2F_6$, $CHF_3CF_4$, $C_6F_{14}$, $C_5H_2F_{10}$, $C_5HF_{11}$, $C_3F_7$—O—$CH_3$, $C_4H_4F_6$, $C_2F_5$—O—$CH_3$, $CO_2$, $O_2$, Ar, $N_2$, Ne and He.

9. A process for the production of elevated pressure gaseous oxygen comprising:

(A) compressing a high temperature multicomponent refrigerant fluid, cooling the compressed high temperature multicomponent refrigerant fluid, expanding the cooled, compressed high temperature multicomponent refrigerant fluid, and warming the expanded high temperature multicomponent refrigerant fluid by indirect heat exchange with said cooling compressed high temperature multicomponent refrigerant fluid and with low temperature multicomponent refrigerant fluid and also with feed air;

(B) compressing low temperature multicomponent refrigerant fluid, cooling the compressed low temperature multicomponent refrigerant fluid, expanding the cooled, compressed low temperature multicomponent refrigerant fluid, and warming the expanded low temperature multicomponent refrigerant fluid by indirect heat exchange with said cooling compressed low temperature multicomponent refrigerant fluid and also with feed air to produce cooled feed air;

(C) passing the cooled feed air into a higher pressure cryogenic rectification column and separating the feed air by cryogenic rectification within the higher pressure cryogenic rectification column to produce oxygen-enriched fluid;

(D) passing the oxygen-enriched fluid into a lower pressure cryogenic rectification column, and producing oxygen-rich liquid by cryogenic rectification within the lower pressure column;

(E) withdrawing oxygen-rich liquid from the lower pressure column, elevating the pressure of the oxygen-rich liquid, and vaporizing the elevated pressure oxygen-rich liquid by indirect heat exchange with the low temperature multicomponent refrigerant fluid to produce oxygen-rich gas; and (F) recovering the oxygen-rich gas as product elevated pressure gaseous oxygen.

10. The process of claim 9 wherein the temperature of the expanded high temperature multicomponent refrigerant fluid is within the range of from 120 to 270K, and the temperature of the expanded low temperature multicomponent refrigerant fluid is within the range of from 80 to 200K.

* * * * *